US007547229B2

(12) United States Patent
Ting

(10) Patent No.: US 7,547,229 B2
(45) Date of Patent: Jun. 16, 2009

(54) STACKED ELECTRICAL CARD CONNECTOR HAVING STAND OFF

(75) Inventor: Chien-Jen Ting, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/148,828

(22) Filed: Apr. 23, 2008

(65) Prior Publication Data

US 2008/0261442 A1 Oct. 23, 2008

(30) Foreign Application Priority Data

Apr. 23, 2007 (TW) ..... 96206455 U

(51) Int. Cl.
*H01R 13/60* (2006.01)

(52) U.S. Cl. ..... 439/541.5; 439/160

(58) Field of Classification Search ..... 439/541.5, 439/159, 160

See application file for complete search history.

(56) References Cited

U.S. PATENT DOCUMENTS

| | | | | |
|---|---|---|---|---|
| 5,591,047 | A * | 1/1997 | Yamada et al. | 439/541.5 |
| 6,059,586 | A * | 5/2000 | Watanabe et al. | 439/159 |
| 6,132,243 | A * | 10/2000 | Hirata et al. | 439/541.5 |
| 6,174,197 | B1 * | 1/2001 | Hirata et al. | 439/541.5 |
| 6,183,273 | B1 * | 2/2001 | Yu et al. | 439/92 |
| 6,231,382 | B1 * | 5/2001 | Yu | 439/541.5 |
| 6,626,689 | B1 * | 9/2003 | Yu | 439/159 |
| 6,648,680 | B1 * | 11/2003 | Hu | 439/541.5 |
| 6,722,921 | B1 * | 4/2004 | Yu | 439/573 |
| 7,018,234 | B2 * | 3/2006 | Tanigawa et al. | 439/541.5 |
| 7,052,316 | B2 * | 5/2006 | Tanigawa et al. | 439/541.5 |
| 7,086,906 | B1 * | 8/2006 | Ting | 439/630 |
| 7,094,097 | B2 * | 8/2006 | Cheng et al. | 439/541.5 |
| 7,108,545 | B2 * | 9/2006 | Ting | 439/541.5 |
| 7,318,746 | B2 * | 1/2008 | Ezaki | 439/541.5 |
| 7,467,976 | B2 * | 12/2008 | Ting | 439/607 |
| 2005/0118863 | A1 * | 6/2005 | Tanigawa et al. | 439/541.5 |
| 2006/0178045 | A1 * | 8/2006 | Ting | 439/541.5 |
| 2008/0261442 | A1 * | 10/2008 | Ting | 439/541.5 |
| 2008/0280487 | A1 * | 11/2008 | Ting | 439/541.5 |

* cited by examiner

*Primary Examiner*—Ross N Gushi
(74) *Attorney, Agent, or Firm*—Wei Te Chung

(57) ABSTRACT

An stacked electrical card connector comprises: a first connector comprising an insulative housing and a first shell covering the insulative housing, said first shell comprising a plurality of retention pieces extending outwardly; a second connector stacking with the first connector, comprising a bottom plate with a protrusion extending outwardly; at least one stand off for combining the first connector and the second connector together, comprising an engagement portion with a group of openings, and one of the openings comprising an elastic piece therein, said retention pieces and protrusion retaining in corresponding openings of the stand off, and the elastic piece withstanding on one of the retention piece in the front-to-back direction.

14 Claims, 4 Drawing Sheets

STACKED ELECTRICAL CARD CONNECTOR HAVING STAND OFF

BACKGROUND OF THE INVENTION

1. Field of the Invention

The present invention generally relates to a stacked electrical card connector, and more particularly to a stacked electrical card connector having a stand off.

2. Description of Prior Art

With the development of electrical appliances, the dimension of the electrical appliances gets more and more smaller so that the electrical appliances need more memory cards to meet the requirement. Accordingly, more and more electrical card connectors are widely used in the electrical appliances. Thus, a stacked card connector arises to save the inner space of the electrical appliance.

A prior art discloses such a stacked electrical card connector comprising a first connector and a second connector stacked with the first connector. The first connector and the second connector are combined by a pair of stand offs. Each stand off comprises two groups of openings and a plurality of spring members between the openings. Each connector comprises a shell with brackets extending outwardly from two opposite sides, and the brackets are disposed in the openings of the stand off. Said spring members engage with gaps mounting on the shell. However, the structure of the stand off is complex to manufacture and assembly, in addition, the spring members of the stand off may escape from the gaps easily to cause the stacked electrical card connector separation.

Hence, it is desirable to have an improved card connector to overcome the above-mentioned disadvantages of the prior art.

BRIEF SUMMARY OF THE INVENTION

Accordingly, the object of the present invention is to provide a stacked electrical card connector having stand offs to combine the stacked electrical card connector reliably.

In order to achieve the above-mentioned object, A stacked electrical card connector comprises: a first connector comprising an insulative housing and a first shell covering the insulative housing, said insulative housing comprising a fix portion, said first shell comprising a plurality of retention pieces extending outwardly; a second connector stacking with the first connector, comprising a bottom plate with a protrusion extending outwardly; a first ejecting mechanism and a second ejecting mechanism mounting on the fixing portion; at least one stand off for combining the first connector and the second connector together, comprising an engagement portion with a group of openings, and at least one of the openings forming an elastic piece therein, said retention pieces and protrusion retaining in corresponding openings of the stand off, and the elastic piece withstanding on the retention piece of the first connector in the front-to-back direction.

Other objects, advantages and novel features of the invention will become more apparent from the following detailed description of the present embodiment when taken in conjunction with the accompanying drawings.

DETAILED DESCRIPTION OF THE INVENTION

Figure 1:
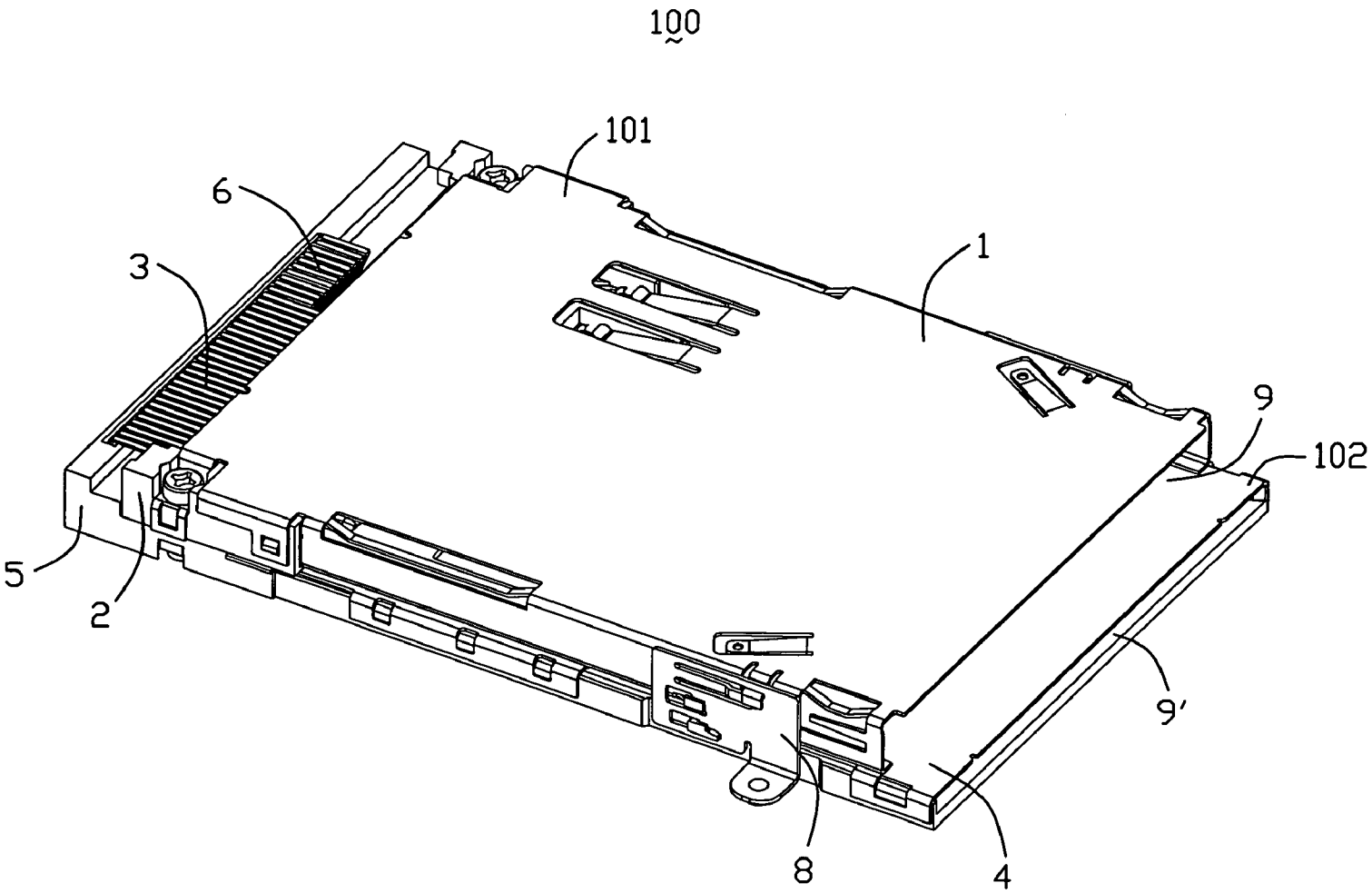
FIG. 1 is a perspective view of a stacked electrical card connector in accordance with the present invention.

Reference will now be made to the drawing figures to describe the present invention in detail.

Referring to FIGS. 1-5, a stacked electrical card connector 100 in accordance with the present invention comprises a first connector 101, a second connector 102 and a pair of stand offs 8. The first connector 101 comprises a first shell 1, a first insulative housing 2 covered by the first shell 1, a plurality of first terminals 3 received in the insulative housing 2, a first mechanism 7' assembled on the first insulative housing 2 and a first card slot 9 defined by the first shell 1 and the insulative housing 2 for receiving a first card. The second connector 102, placed under the first connector 101, comprises a second shell 4, a terminal module 45 aligned with the second shell 4, a bottom plate 5 engaging with the second shell 4 to define a second card slot 9' for receiving a second card and a second mechanism 7.

Figure 2:
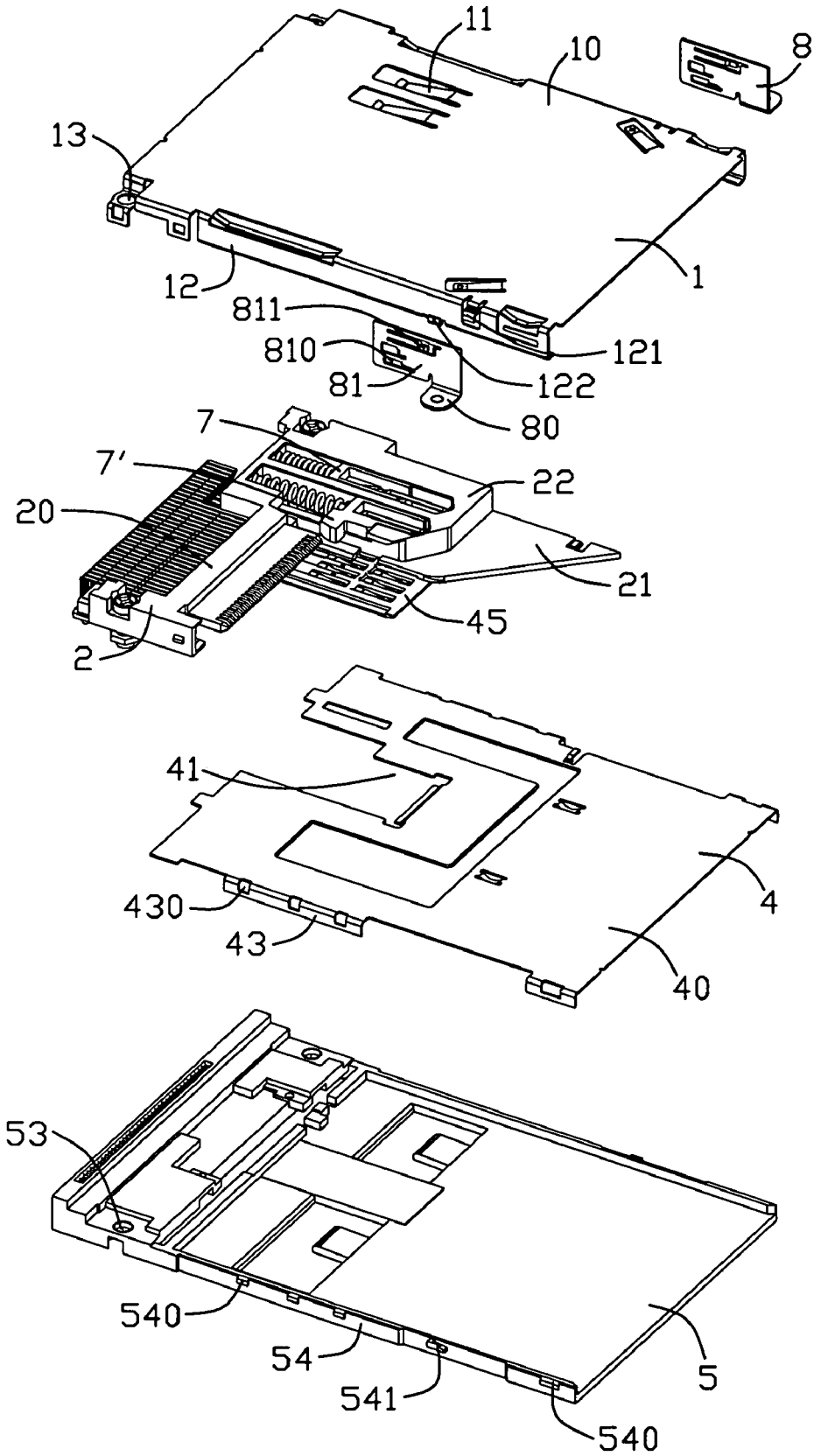
FIG. 2 is an exploded, perspective view of the stacked electrical card connector shown in FIG. 1.

Referring to FIG. 2, the first shell 1 comprises a main portion 10 with a pair of pressing pieces 11 thereon and a pair of lateral walls 12 extending downwardly from the two opposite sides of the main portion 10. The main portion 10 and the lateral walls 12 defines an inserting opening (not labeled) for the first card inserting into the first connector 101. The main portion 10 further defines a pair of screw holes 13 in the front thereof. A plurality of retention pieces 121, 122, approaching to the inserting opening, extend outwardly from the main portion 10 and the lateral walls 12, respectively. The end of the retention piece 121 faces downwardly from the lateral side of the main portion 10 and the end of the retention piece 122 faces upwardly from bottom of the lateral walls 12.

Figure 3:
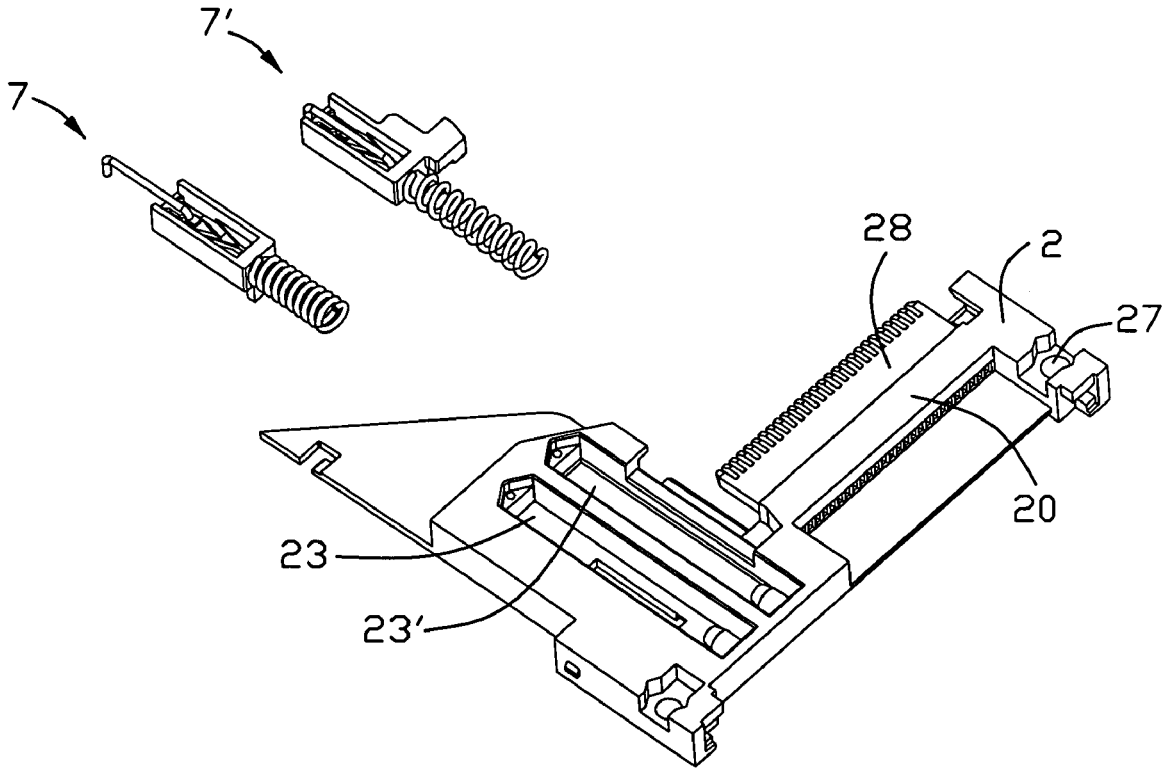
FIG. 3 is a perspective view of an insulative housing and a pair of ejecting mechanisms of the connector.

Referring to FIG. 2 and FIG. 3, the insulative housing 2 comprises a base portion 20 receiving the first terminals 3, a mating portion 28 extending backwardly from the base portion 20, a fixing portion 22 extending laterally from the base portion 20 and a guiding portion 21 extending backwardly from the fixing portion 22. The fixing portion 22 comprises a first groove 23' adjacent to the first card slot 9 and a second groove 23 arranged in a transverse line with the first groove 23' to receive the first ejecting mechanism 7' and a second mechanism 7, respectively. The pressing pieces 11 are located at the top of the ejecting mechanisms 7', 7. The insulative housing 2 further comprises a pair of screw holes 27 running through the screw holes 13 of the first shell 1.

Figure 4:
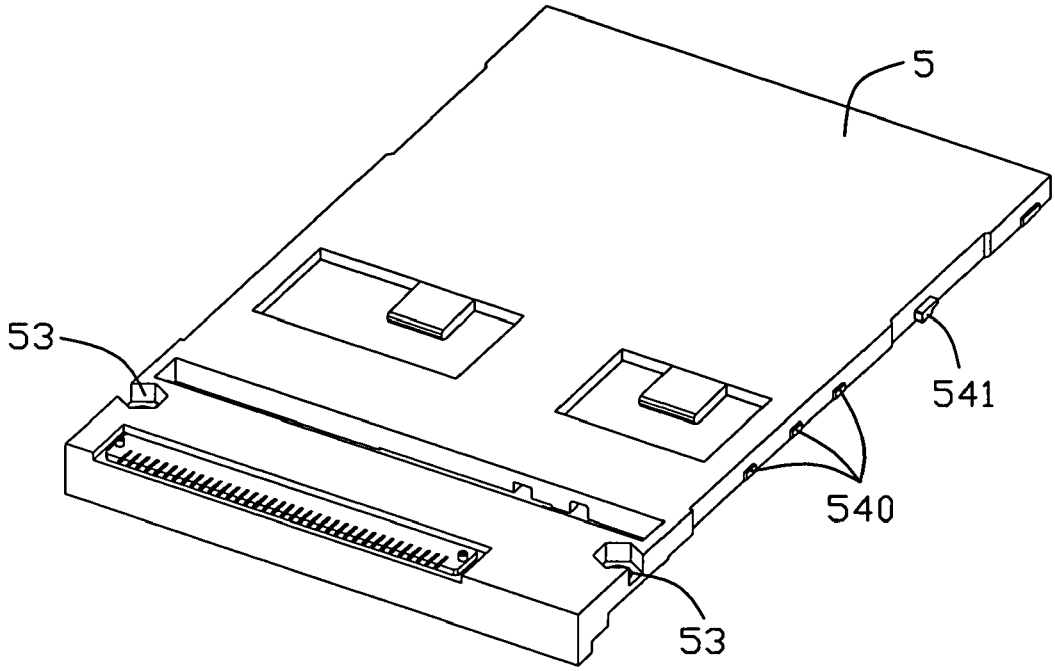
FIG. 4 is a perspective view of a bottom plate apart from the card connector in accordance with the present invention.
Figure 4:
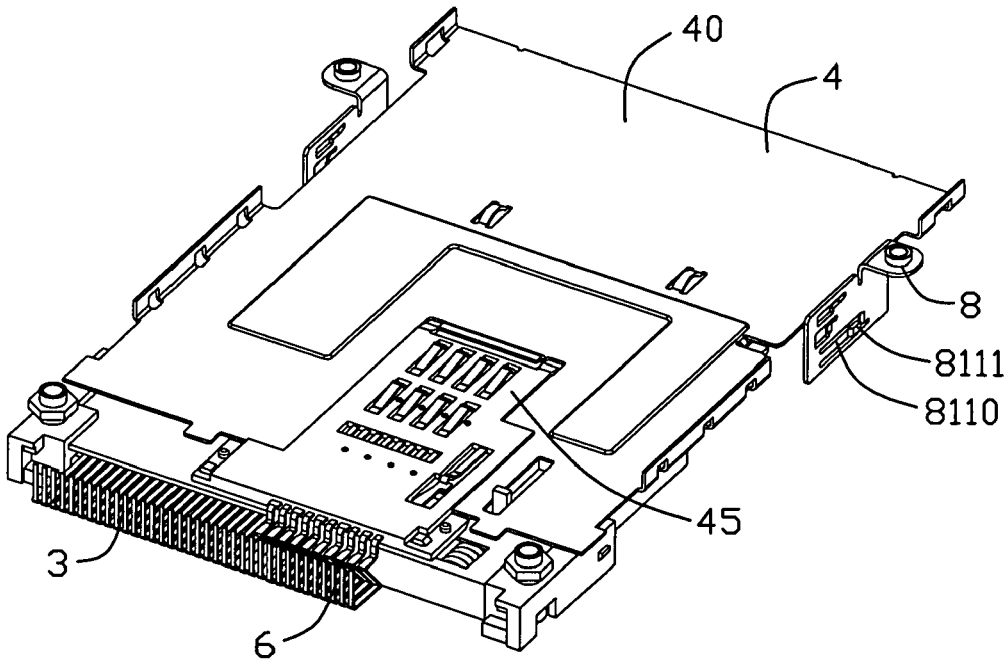

Referring to FIG. 2, FIG. 4 and FIG. 5, the second shell 4 comprises a top surface 40 separating the first card slot 9 and the second card slot 9', and a pair of lateral portions 43 extending downwardly from two opposite sides of the top surface 40. An L-shape opening 41 is defined in the front of the top surface 40 for receiving the terminal module 45 therein. Said terminal module 45 receives a plurality of second terminals 6 protruding into the second card slot 9' to engage with the second card such as a Smart Card. Said second terminals 6 are arranged in two rows in a front-to-back direction. Each lateral portion 43 of the second shell 4 further comprises a plurality of retaining holes 430.

The bottom plate 5, made by plastic, is located at the bottom of the electrical card connector 100 and assumes an elongated shape. Said bottom plate 5 comprises a pair of screw holes 53 in the front thereof running through the screw holes 13 of the first shell 1 and the screw holes 27 of the insulative housing 2. The bottom plate 5 further forms a plurality of tubers 540 and a protrusion 541 on the lateral side thereof. In other way, the protrusion 541 may have the same structure of the retention pieces 121, 122 of the first shell 1. The tubers 540 engage with corresponding retaining holes 430 of the second shell 4.

Referring to FIG. 1, FIG. 2 and FIG. 4, a pair of stand offs are located at the end of the electrical card connector 100 for combining the first connector 101 and the second connector 102 together and retaining them on a Print Circuit Board (PCB) (not shown). Each stand off comprises an engagement portion 81 with the same height of the electrical card connector 100 and an installment portion 80 extending outwardly from bottom of the engagement portion 81. Said engagement portion 81 defines a group of openings 810. One of the openings 810, longer than the others, has an elastic piece 811 therein. Said openings 810 comprises a wide end and a narrow end for engaging with the retention pieces 121, 122 and the protrusion 541 reliably to limit the stand off 8 moving in the up-to-down direction. The elastic piece 811 forms an elastic portion 8110 and a withstanding portion 8111 extending backwardly and outwardly from the elastic portion 8110, and the withstanding portion 8111 is against on the retention pieces 121 for limiting the stand off 8 moving in the front-to-back direction. Before the stand off 8 assembled, the retention piece 121 presses on the withstanding portion 8111 leading to the elastic portion 8110 bending inwardly, and the withstanding portion 8111 is opposed on the retention piece 121 in the front-to-back direction finally.

This invention completes the assembly through the below process: a pair of screws (not labeled) pass through the screw holes 13, 27 and 53 orderly to fix the first connector 101 and the second connector 102 together in the front portion. In addition, stand offs 8 mounted on the lateral side of the electrical connector 100 fix the rear portion of the connector 100 together. The first ejecting mechanism 7' and the second mechanism 7 are placed correspondingly in the first groove 23' and the second groove 23 of the fixing portion 22 with the pressing pieces 11 pressing on.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked electrical card connector comprising:

a first connector comprising an insulative housing and a first shell covering the insulative housing, said insulative housing comprising a fixing portion, said first shell comprising a plurality of retention pieces extending outwardly;

a second connector stacking with the first connector, comprising a bottom plate with a protrusion extending outwardly;

a first ejecting mechanism and a second ejecting mechanism mounting on the fixing portion;

at least one stand off for combining the first connector and the second connector together, comprising an engagement portion with a group of openings, at least one of the openings forming an elastic piece therein, said retention pieces and said protrusion retaining in corresponding openings of the stand off, the elastic piece engaging the retention piece of the first connector in the front-to-back direction.

2. The stacked electrical card connector as claimed in claim 1, wherein the stand off comprises an installment portion extending outwardly from the bottom of the engagement portion.

3. The stacked electrical card connector as claimed in claim 1, wherein the elastic piece comprises an elastic portion and a withstanding portion extending backwardly and outwardly from the elastic portion.

4. The stacked electrical card connector as claimed in claim 3, wherein the retention piece presses on the withstanding portion causing the elastic portion to bend inwardly before the stand off is assembled, and the withstanding portion is opposed on the retention piece finally.

5. The stacked electrical card connector as claimed in claim 1, wherein the opening with an elastic piece therein is longer than the other openings in front-to-back direction.

6. The stacked electrical card connector as claimed in claim 1, wherein the protrusion is integral with the bottom plate.

7. The stacked electrical card connector as claimed in claim 1, wherein the insulative housing comprises a base portion and a mating portion extending backwardly from the base portion, and wherein a plurality of first terminals are received in the mating portion.

8. The stacked electrical card connector as claimed in claim 7, wherein the fixing portion is arranged in a transverse line with respect to the base portion and extends from the base portion.

9. The stacked electrical card connector as claimed in claim 8, wherein the fixing portion comprises a first groove and a second groove for receiving the first ejecting mechanism and the second ejecting mechanism.

10. The stacked electrical card connector as claimed in claim 1, wherein the second connector comprises a terminal module receiving a plurality of second terminals which are arranged in two rows in a front-to-back direction.

11. An electrical card connector assembly comprising:

a first connector defining a pair of opposite first side arms extending along a front-to-back direction;

a second connector stacked upon the first connector and defining a pair of opposite second side arms extending along the first-to-back direction;

a first retention device being of a hook type and located on one of said first side arms;

a second retention device being of the hook type and located on a corresponding one of said second side arms adjacent to said first retention device;

a standoff functioning to fastening the first connector and the second connector together in a vertical direction perpendicular to said front-to-back direction, said standoff defining first and second openings corresponding to the first retention device and the second retention device, each of said first and second opening defining a large section and a small section communicating with each other in said front-to-back direction so as to allow the corresponding retention device to be initially received in the large section in a lateral direction perpendicular to both said front-to-back direction and said vertical direction, and successively located in the small section after the standoff and the corresponding retention device have a relative movement along said front-to-back direction, thus assuring the corresponding retention device is restrained with regard to the standoff in said lateral direction;

said standoff further including an elastic piece, and one of the corresponding first side arm and second side arm defining a retention piece; wherein an engagement occurs between the retention piece and the elastic piece in said front-to-back direction; wherein said engagement prevents the retention device from moving from the small section back to the large section of the corresponding opening unless said elastic piece is forcibly deflected in the lateral direction by said retention piece.

12. An electrical connector assembly comprising:

a connector defining at least one side arm extending along a front-to-back direction;

a standoff defining a height larger than that of the connector in a vertical direction perpendicular to the front-to-back direction for fastening the connector to a printed circuit board on which the connector is mounted;

a hook formed on one of the standoff and said side arm;

an opening formed in the other of said standoff and said side arm, said opening defining a large section an a small section communicating with each other in said front-to-back direction so as to allow the hook to be initially received in the large section in a lateral direction perpendicular to both said front-to-back direction and said vertical direction, and successively located in the small section after the standoff and the hook have a relative movement along said front-to-back direction, thus assuring the hook is restrained with regard to the standoff in said lateral direction;

an elastic piece defined on one of said standoff and said side arm;

a retention piece defined on the other of said standoff and said side arm; wherein an engagement occurs between the retention piece and the elastic piece in said front-to-back direction; wherein said engagement prevents the hook from moving from the small section back to the large section of the opening unless said elastic piece is forcibly deflected in the lateral direction by said retention piece.

13. The electrical connector assembly as claimed in claim 12, wherein the retention piece is formed on the side arm and the elastic piece is formed on the standoff.

14. The electrical connector assembly as claimed in claim 12, wherein the hook is formed on the side arm and the opening is formed in the standoff.

* * * * *